US009022912B2

(12) United States Patent
Matsuno

(10) Patent No.: US 9,022,912 B2
(45) Date of Patent: May 5, 2015

(54) STEP PLATFORM FOR SLOW STEP EXERCISES

(75) Inventor: Keishi Matsuno, Fukuoka (JP)

(73) Assignee: JunKen Co., Ltd, Fukuoka (JP)

( * ) Notice: Subject to any disclaimer, the term of this patent is extended or adjusted under 35 U.S.C. 154(b) by 0 days.

(21) Appl. No.: 13/581,218

(22) PCT Filed: Feb. 23, 2011

(86) PCT No.: PCT/JP2011/053959

§ 371 (c)(1),
(2), (4) Date: Aug. 24, 2012

(87) PCT Pub. No.: WO2011/105419

PCT Pub. Date: Sep. 1, 2011

(65) Prior Publication Data

US 2012/0316044 A1 Dec. 13, 2012

(30) Foreign Application Priority Data

Feb. 26, 2010 (JP) ..... 2010-042054
Apr. 28, 2010 (JP) ..... 2010-102959

(51) Int. Cl.
*A63B 26/00* (2006.01)
*A63B 22/04* (2006.01)
(Continued)

(52) U.S. Cl.
CPC ..... *A63B 23/0458* (2013.01); *A63B 71/0622* (2013.01); *A63B 2220/17* (2013.01); *A63B 2220/56* (2013.01); *A63B 2220/80* (2013.01)

(58) Field of Classification Search
CPC ..... A63B 23/0458; A63B 21/00047; A63B 2210/50; A63B 2208/0204; A63B 2071/0063; A63B 21/1457; A63B 6/00; E04B 2002/026
USPC ..... 482/52, 51, 74, 142; D21/662, 670, 671
See application file for complete search history.

(56) References Cited

U.S. PATENT DOCUMENTS 5,154,678 A * 10/1992 Adamczyk et al. ..... 482/52
5,318,489 A * 6/1994 Irwin ..... 482/52
(Continued)

FOREIGN PATENT DOCUMENTS

JP S54-074129 A 6/1979
JP S63-029555 U 2/1988
(Continued)

OTHER PUBLICATIONS

International Search Report from the International Bureau of WIPO for International Application No. PCT/JP2011/053959 dated Mar. 22, 2011 (2 pages) and an English translation of the same (3 pages).
(Continued)

*Primary Examiner* — Bhisma Mehta
*Assistant Examiner* — Sundhara Ganesan
(74) *Attorney, Agent, or Firm* — Fitch Even Tabin & Flannery LLP

(57) ABSTRACT

A step platform for slow step exercises is provided and has a basic structural block which is formed as a solid block made of a lightweight styrene foam material and includes a plurality of first concave portions formed in a bottom surface of styrene foam by using a plurality of first hollow holes formed in a predetermined shape which includes a penetrating hole perpendicularly penetrating the styrene foam from the bottom surface toward the upper surface or which includes a non-penetrating portion formed inside the penetrating hole; and predetermined single or plural step plates for distributing a load and ensuring a load bearing performance, bonded or adhered to the upper surface of the basic structural block.

17 Claims, 5 Drawing Sheets

(51) Int. Cl.
*A63B 23/04* (2006.01)
*A63B 71/06* (2006.01)

(56) References Cited

U.S. PATENT DOCUMENTS

| | | | | |
|---|---|---|---|---|
| 5,772,559 | A * | 6/1998 | Sithole | 482/52 |
| 8,176,697 | B1 * | 5/2012 | Bolander, II | 52/309.4 |
| 2005/0101444 | A1 * | 5/2005 | Dadbeh | 482/52 |
| 2006/0258512 | A1 * | 11/2006 | Nicolas et al. | 482/52 |
| 2008/0220944 | A1 * | 9/2008 | Pratson et al. | 482/52 |
| 2009/0227427 | A1 * | 9/2009 | Park | 482/52 |

FOREIGN PATENT DOCUMENTS

| | | | |
|---|---|---|---|
| JP | 2006-141694 | A | 10/1992 |
| JP | H05-220235 | A | 8/1993 |
| JP | 3043265 | U | 9/1997 |
| JP | H10-131282 | A | 5/1998 |
| JP | H10-192445 | A | 7/1998 |
| JP | H10-231672 | A | 9/1998 |
| JP | 2000-248706 | A | 9/2000 |
| JP | 2004-290691 | A | 10/2004 |
| JP | 3114757 | U | 9/2005 |
| JP | 2007-051484 | A | 3/2007 |
| JP | 2007-205146 | A | 8/2007 |

OTHER PUBLICATIONS

Written Opinion of the International Searching Authority from the International Bureau of WIPO for International Application No. PCT/JP2011/053959 dated Mar. 22, 2011 (3 pages) and an English translation of the same (3 pages).

* cited by examiner (a)

(b)

(c)

STEP PLATFORM FOR SLOW STEP EXERCISES

CROSS-REFERENCE TO A RELATED APPLICATIONS

This application is a U.S. national phase application filed under 35 U.S.C. §371 of International Application PCT/JP2011/053959, filed on Feb. 23, 2011, designating the United States, which claims priority from Japanese Application 2010-042054, filed on Feb. 26, 2010 and Japanese Application 2010-102959, filed on, Apr. 28, 2010, which are hereby incorporated herein by reference in their entirety.

TECHNICAL FIELD

The present invention relates to a step platform for slow step exercises aimed at decreasing the weight and size of step platforms used in slow step exercises.

BACKGROUND ART

In order to meet the strong desires of a person who wishes to be healthy throughout life in response to an aging society, many health classes are held as a group in places with broad floor areas such as gymnasiums or the like in respective regions. On the other hand, there has been a demand for development, commoditization and promotion of a simple health promotion instrument for managing individual health during work breaks in any narrow place such as at home or at the sides of an aisle at work. The introduction for promotional purposes of slow step exercises under such circumstances came from recent news reports such as television program "Tamesitegatten" of NHK in Aug. 5, 2009, which may be searched and downloaded from the internet, and Fukuoka City News Chuo Ward Edition (Feb. 15, 2010).

As an example, in a web store, "Rakuten Ichiba", a step platform for slow step exercises used in slow step exercises is sold as a plastic product having the product name of "STEPWELL 2 (Combi Wellness Corporation)" or a wooden product having a product name of "Slow Step 500". Among these, as one example in the product specification for STEPWELL 2, the body is formed of plastic (PP+ABS) so that the horizontal width is 800 millimeters, the depth is 300 millimeters, and the height is adjusted in five levels at intervals of 25 millimeters from 100 millimeters to 200 millimeters by a height adjusting block component with a weight of the body of about 3.6 kg and the weight limit thereof in use of 100 kg. In JP 2007-205146 A, a step platform is provided for use in working at high places that is aimed at not damaging objects even in the event of a collision in interior construction sites. At such a site, there is a need to provide a lightweight step platform in which an anti-slip rubber is adhered to a surface of a styrene foam solid block, but there is no concept of a step platform for slow step exercises. Further, in JP 2007-051484 A, there is provided a home step platform having a height adjusting step frame used for reinforcing leg strength.

In the step platform for slow step exercises which is mentioned above and has been sold conventionally as a product, the total weight and size are inconvenient for use by an elderly person who wish to maintain and enhance health or comparatively weak people who need to improve leg strength when handling the step platform (for example, when carrying it to an exercise place, setting the height, and the like). Further, in order to use the step platform as a simple health promotion instrument for managing individual health during work breaks in narrow spaces at home and or work places, there are the problems of decreases in the weight and size of the step platform, ease of adjustment of the height thereof, and ease of setup regardless of the place. JP 2007-205146 A introduces a lightweight step platform in which the anti-slip rubber is adhered to the styrene foam solid block. Further, the step platform adhered with the anti-slip rubber is used to prevent loosing one's footing on the step platform, but there is no description that the rectangular parallelepiped styrene foam is used in consideration of the small load bearing strength so that the load is distributed in the step plate. Further, regarding the height of the step platform, there is no description other than an examination of use in which the height is increased by stacking the rectangular parallelepiped step platforms. As described above, it was considered that a step platform using a conventional styrene foam generally used with an expansion ratio of 60 times could be used to hold a person only with a solid structure. Further, step platforms which use a conventional styrene foam are not used as a fixture for an extremely large number of mounting and dismounting.

Next, in the related art described below, the problem of a step platform having a hollow body or a hollow space is illustrated. In JP H10-131282 A, since a substantially box-like hollow body with an upper opening portion is formed in a step platform for access to a back door many of which do not have steps in Japan with the hollow portion to be used for a water outlet, the upper opening portion including a drain tank increases in size. Therefore, it is considered that the material of this step platform would have insufficient load bearing strength with normal foam. Accordingly, in this case, glass fiber reinforced polyurethane foam is exemplified as the foam. In JP 2000-248706 A, a step platform for access to a back door is formed of synthetic resin foam and the step platform and a step portion are all formed in a hollow box shape of which a lower end is opened, and a reinforcement rib, a reinforcement wall, and the like are formed therein so as to improve the load bearing strength. Further, an underlying net is interposed between the upper coating surface of the step platform and the step portion and the foam so as to reinforce load strength. In JP H10-231672 A, a resin foam block built in a step forming portion of a step-shaped step platform for access to a door is formed of a 30 to 45 times expanded polystyrene, and is densely charged inside the step forming portion. Further, even in this case, the opening portion of the hollow body is large, and the step platform is reinforced by inner and outer annular ribs and a lattice-shaped rib, and further reinforcing metal pipe.

From the above-described disclosed documents, in a step platform having a hollow body or the hollow space and having a large opening portion, it is considered that some kind of reinforcement is essential. Accordingly, in a step platform using a normal styrene foam with an expansion ratio of 60 times, in order to satisfy the load bearing strength, there is a need to limit the relatively small opening portion to a size equal to or smaller than a predetermined opening portion corresponding to the magnitude of the load. Further, at this time, even in a case where the step platform is used as a unit in which the number of times of mounting and dismounting the step platform is extremely large, there is a need to realize durability for sufficient use.

Even in such circumstances, there is a need to develop a compact step platform for slow step exercises which is light in weight, with a load bearing performance, durability, and a height adjusting function. Furthermore, there is a need to develop a compact step platform for slow step exercises with a function for displaying the number of times or count of mounting and dismounting the step platform, which is considered to be essentially necessary for increasing the so-called incentive of encouraging a user.

SUMMARY OF THE INVENTION

The invention solves the problems of the products of the related art, and it is an object of the invention to newly develop a compact step platform for slow step exercises on which a person may mount even when the step platform is formed by using a normal styrene foam solid block of the related art in which a hollow hole is formed therein and which is sufficiently durable for repeated use of the step platform. Also, it is an object of the invention to provide a step platform for slow step exercises which realizes a decrease in weight while taking advantage of the characteristics of styrene foam as a lightweight material, which leads to a height adjustment function and a carrying and setup function essentially necessary in a step platform for slow step exercises used as a unit in which the number of mounting and dismounting is extremely large and leads to an optimal shape and an optimal structure in consideration of the convenience of a user of the step platform.

According to a first characteristic of the invention, there is provided a step platform for slow step exercises including: a basic structural block which is formed as a solid block made of a lightweight material such as styrene foam and includes a plurality of first concave portions formed in a bottom surface of the styrene foam by using a plurality of first hollow holes formed in a predetermined shape and a predetermined size which includes a penetrating hole perpendicularly penetrating the styrene foam from the bottom surface toward the upper surface or which includes a non-penetrating portion formed inside the penetrating hole; and a basic structural portion for distributing load and ensuring load bearing performance, bonded or adhered to the upper surface of the basic structural block.

In addition to the first characteristic, according to a second characteristic, the step platform for slow step exercises includes a height adjusting block which is made of a material similar to the styrene foam solid block and includes a plurality of convex portions formed on the upper surface thereof so as to be respectively inserted and coupled to the plurality of corresponding first concave portions and a plurality of second concave portions formed on the bottom surface thereof by a plurality of second hollow holes formed at a position corresponding to a position directly below the plurality of convex portions so as not to penetrate from the bottom surface by a predetermined depth.

In addition to the first or second characteristic, according to a third characteristic, a step platform for slow step exercises having different heights is formed by inserting and coupling a plurality of convex portions, provided in single or plural height adjusting blocks and formed so as to be coupled to the corresponding first or second concave portions so that the single or plural height adjusting blocks are coupled to the basic structural portion in multiple levels, to the plurality of corresponding first or second concave portions.

According to a fourth characteristic, in order to maximally increase the load bearing performance when a person mounts the step platform for slow step exercises of the invention and to prevent degradation (for example, the occurrence of cracks, shrinkage, and the like) of the styrene foam receiving repeated loads, the area of the step plate, the thickness of the step plate, and the material of the step plate of the step platform for slow step exercises provided in the basic structural portion and the number of holes, the size of the holes, the shape of the holes, and the position of the holes forming the plurality of first or second hollow holes and the first or second concave portions are formed as optimally as possible.

According to a fifth characteristic, an anti-slip rubber sheet or an anti-slip mat is bonded or adhered to the bottom surfaces of the basic structural portion and the height adjusting block if necessary.

In addition to the first characteristic, according to a sixth characteristic, the step platform for slow step exercises according to the invention further includes a display device with a display unit for displaying a count value, where the display device provides a function of counting and displaying the number of times in which a person mounts and dismounts from the step platform for slow step exercises. Here, a pressure sensor or a piezoelectric sensor is disposed so as to correspond to a portion of the step plate (hereinafter, referred to as a "first step plate") to which loads are applied from the left and right legs, detects a signal level by an electronic circuit, adjusts a waveform level, and counts the above number of times. For this reason, in addition to the first step plate, second and third step plates may be provided so as to correspond to the load application portions of the left and right legs, and the new second and third step plates obtained by bonding or adhering a pressure sensor or a piezoelectric sensor to the bottom surfaces of the second and third step plates may be stacked on the step plate. In this case, in order to count a series of mounting and dismounting step operations performed in slow step exercises to be described later as one time, the count value may be regarded as effective only when a load is not continuously applied to the second and third step plate for a predetermined time.

In the basic structural portion having the first characteristic, even when the casing or cushioning styrene foam generally used with an expansion ratio of about 60 times is used in consideration of the characteristics of the styrene foam which is strong against compression forces and weak against pulling forces, a decrease in weight and size is realized by distributing the load and disposing the hollow holes optimally. When the load bearing performance is not sufficient, a styrene foam having an expansion ratio of 50 times or 40 times may be used. However, in this case, since the styrene foam becomes harder, the cushioning performance is degraded. Furthermore, the size and the shape of the uneven portion which is used to be coupled to the hollow holes need not necessarily be the same.

In the height adjusting block having the second characteristic, a predetermined shaped portion having the convex portion and the second concave portion and formed of styrene foam is formed at a position corresponding to the position directly below the plurality of first hollow holes to which no load is applied in the vertical direction, which enables the multi-level coupling operation. As a result, even when the height adjusting blocks are coupled to each other, the solid portion excluding the plurality of convex portions and the plurality of second concave portions may receive as maximum a load as possible.

In the height adjusting block having the third characteristic, the step platforms may be stacked in multiple levels as in the case of the commercially available stacked block where the height can be adjusted by coupling the same height adjusting blocks to each other in multiple levels, and the step platforms may be stably and integrally coupled to each other so as to prevent degradation in the styrene foam due to the load from repeated use. In this case, the types needed to set the height of the step platform are narrowed down to three, and hence the entire structure of the step platform for slow step exercises may be simplified and the step platforms may be easily handled.

In the step platform for slow step exercises having the fourth characteristic, first, the area of the step plate may be set to a size sufficiently large enough to be used as a step platform for slow step exercises, the depth thereof is sufficiently shorter than at least the length of a person's foot and need not be longer than the length from the heel of the foot to the toe, and the transverse length may be sufficiently set to the width of a person's shoulders.

Further, the thickness of the step plate is set to sufficiently withstand the normal weight of a person. When a plate thickness having excessively large rigidity is sought, the cushioning performance as a characteristic of the styrene foam material is degraded, and hence the plate thickness is optimally set so as to correspond to the materials of the plate and the styrene foam, the size of the hollow holes, and the like.

The material of the step plate may be realized as low-cost wood. Then, regarding flatness which may cause an unpleasant sensation to the sole of the foot of the person mounting the step platform, plywood having excellent flatness may be used, since there is no so-called warping of the plane caused when the wood used in the step plate is dried and since it is desirable to have flatness sufficient enough to provide a tight seal without any gaps in the attachment of the basic structural portions.

Regarding the hollow holes, that is, the number of hollow holes, the position of the holes, the size of the holes, and the shape of the holes, two commercially available styrene foam blocks (for example, one with a size width of 39×a depth of 19×a height of 10 centimeters and the like) are used, and are coupled to each other by double-sided tape so as to make and examine various test models. As a result of this, the number of holes and the number of hole positions needs to be at least two or more, and the number needs to be eight or less. When the step platform is formed so that a part or the entirety of the holes overlap the bottom of the foot of the user through the step plate, it is found that the impact generated when mounting the step plate may be lessened and the foot bottom contact sensation may be good since the step plate slightly bends due to a cushioning performance as a characteristic of the styrene foam material. Accordingly, a structure with such a positional relation is obtained. As an example, in the test results of the test model mentioned below, when a person weighing 70 kg, plywood having a plate thickness of 6 millimeters is used. Here, it is obvious that the number of first hollow holes and the number of second hollow holes need not necessarily be equal to each other. In this specific example of the invention, the number of first hollow holes is set to 6, and the number of second hollow holes is also set to 6. Furthermore, the shape of the portion of the hollow hole contacting the step plate is formed in a transverse elongated shape in the front view, but it is obvious that the shape may be formed in a vertically elongated shape by rotating the shape by 90°. In this case, since the overlapping portion between the bottom of the foot mounting the step platform and the hollow hole becomes stronger and wider, the foot bottom contact sensation becomes stronger. However, since the force exerted in the direction to transversely widen the hollow hole becomes strong, there is a need to select the size and shape of the hole in a range so that durability is not degraded.

Regarding the size and shape of the hole, a product which is substantially similar to the test model but has a hole not larger than that of the test model is adopted for safety as a result of the consideration that the area of the solid portion other than the hollow styrene foam forming portion in the area contacting the step plate needs to have a sufficient area for distributing the load so as to ensure good load bearing performance and the plurality of corresponding convex portions is easily inserted and coupled to the plurality of first or second concave portions. In the invention, as an example, the size of the opening portion of the hollow hole is about 5 centimeters× about 8 centimeters. Accordingly, the styrene foam is not degraded due to loads applied to the opening portion of the hollow hole, and the load may be sufficiently distributed by using the step plate. Further, in this structure, there is no need to provide any special reinforcement walls, reinforcement ribs, and the like from the viewpoint of the structure of the step platform to arrive at a structure that may be easily manufactured.

Further, since the required number of types capable of setting the height of the step platform is narrowed down to three, the entire structure of the step platform for slow step exercises is simplified, and the step platform may be easily handled. In this case, it is obvious that the desired height of the step platform may be set by freely combining the height of the basic structural block formed of the styrene foam and the height of the height adjusting block. Here, of course, a sufficient height (for example, generally, about 18 to 24 centimeters) may be easily realized just by the basic structural portion without using the height adjusting block, and the manufacturing costs may be reduced. Further, there is a known technique of performing a so-called urethane treatment on the surfaces of the concave portion and the convex portion of the styrene foam so as to prevent the styrene foam from being cracked or chipped, whereby the protection reinforcement may be performed if necessary.

As long as the minimum width portion of the surface receiving a load from the step plate of the solid portion other than the hollow hole is not narrower than the minimum width portion (having a minimum width of 15 millimeters) of the test model using at least a commercially available styrene foam block, the minimum width portion is formed so as to have substantially the same size and shape as those of the case where a commercially available low-cost product is adopted, whereby a structure which realizes a decrease in weight and size and a sufficiently necessary load bearing performance is obtained. Specifically, the minimum width is set to 25 millimeters.

The anti-slip rubber sheet or the anti-slip mat which is bonded or adhered, if necessary, to the respective bottom surfaces of the basic structural portion and the height adjusting block having the fifth characteristic improve safety when using the step platform for slow step exercises and prevents or reduces problems caused by decreases in weight, for example, problems in which the step platform moves when repeatedly mounting and dismounting the step platform or problems in which the step platform is inadvertently kicked when the legs tire due to continuous slow step exercises. Further, at the same time, the anti-slip rubber sheet or the anti-slip mat prevent degradation in the styrene foam due to the load or a change in the adhesion of the coupling portion due to repeated use when the first or second concave portion is coupled to the convex portion. Further, the anti-slip rubber sheet or the like need not be used in the respective bottom surfaces of the basic structural portion or the height adjusting block, and the anti-slip rubber sheet or the anti-slip mat may be easily detachably adhered to the bottom surface contacting the surface of the floor of the first or second concave portion after the height is adjusted. According to the test results of the test model, when the anti-slip mat is adhered, it is found that the compatibility to the styrene foam is satisfactory and the cushioning effect is also improved in addition to the anti-slip effect of the mat.

In the step platform for slow step exercises having the sixth characteristic with a count display function for counting and displaying the number of mounts and dismounts of a person, it is desirable that the thickness of the sensor unit be set as small as possible when the pressure sensor or the load sensor to be used is provided. Therefore, as an example, a button sensor "FlexiForce" which is sold by Nitta Corporation is used. The sensor is a paper thin film-like sensor which has sufficient flexibility and excellent durability and responsiveness in load signal detection. As a similar sensor, a piezoelectric film sensor may also be used.

Further, since the mounting and dismounting step procedure of the exercise is unique in slow step exercises, the following procedure is followed. That is, in slow step exercises, first, either the left or right leg is used to mount the step platform, and then the other leg mounts the step platform. At this time, the total weight of the person mounting the step platform is applied to the step platform. Next, the first leg to mount is used to alight from the step platform back to the floor behind it and the other leg is also brought back down to the floor behind the step platform, in a series of mounting and dismounting step operations alternately repeated for the left and right legs.

Therefore, in order to detect a series of mounting and dismounting step operations as one count value, the magnitudes of the loads applied by the left and right legs are detected by the respective sensor circuits, the waveform level is adjusted, and then the adjusted value is compared with a predetermined rated value. After a load of a certain value or more is detected by both sensor circuits, and a state where no load is applied for a certain period or more of time is detected so as to generate one count pulse. As an example of a circuit which does not erroneously operate even when a non-load state occurs for a short time, for example, a load detecting electric pulse signal is input to a retriggerable monostable multivibrator IC, so that a pulse waveform of a predetermined time interval or less is not generated. This is because there is a possibility of causing a non-load state for a short time. Here, an example has been introduced in which the sensors are provided so as to correspond to the respective right and left legs, but there may be a single or plural load detecting sensor. It is obvious that the load detecting sensors may not necessarily correspond to the left and right legs. With such an operation, a count pulse may be generated without any erroneous operation even when there is a non-load period for a short time (several microseconds to several hundreds of milliseconds). Further, in a case where the load detecting sensors do not correspond to the left and right legs, when single or plural load detecting sensors are installed through a spacer between the first step plate and the basic structural block without using the second and third step plates, it is possible to obtain a count value without any degradation in the cushioning performance due to the step plates stacked in multiple levels. When the display count value is accurately recognized, there is a large merit that the count value may be used as a reference for the amount of exercise of the user and the objectives management of health enhancement of the user may be easily conducted.

As described above, since the present invention makes it possible to use casing and cushioning styrene foam generally used with an expansion ratio of about 60 times that conventionally could not be used for a step platform where a person repeatedly mounts and dismounts due to the low load bearing performance, the entire weight of the step platform for slow step exercises may be drastically decreased by about 1 kg or less compared to the weight (about 3.6 kg) of commercially available products.

Further, as the technique is improved by optimizing the structure by devising a load distributing structure formed of the styrene foam material through confirmatory experiments using test models, a step platform for slow step exercises having load bearing performance and durability sufficient for use may be decreased in size.

Further, in the present invention, although a lightweight styrene foam material is used, there is no degradation in load bearing performance, and the height of the step platform may be adjusted as is the case for step platforms for slow step exercises sold in the past. Then, since the minimally necessary step platform structure is narrowed down to three levels of height by examining the test model, the entire structure of the step platform for slow step exercises may be simplified and the step platform may be easily handled.

Further, since the area of the step platform, the thickness of the step plate, the hollow hole of the step platform, and the like are set as optimally as possible, a structure having a step plate area which is much smaller than that of the existing product may be obtained. As a result, the step platform is decreased in size so that slow step exercises may be performed in narrow spaces at home, the office, and the like. Further, both side surfaces (the side surfaces of the basic structural block and the height adjusting block) of the step platform are provided with a substantially semi-circular columnar penetrating portion which is obtained by removing some of the styrene foam, so that the step platform may be carried by one hand. Accordingly, it is possible to provide a step platform for slow step exercises which may be easily carried and set up in easily selected places.

Further, since the plate thickness of the step plate is set to a predetermined thickness without decreasing the cushioning effect of the styrene foam used as the formation material and the anti-slip mat is adopted, it is possible to provide a step platform for slow step exercises which provides a good sensation of touch to the bottom of the foot and reduces the burden on the knee.

Further, since the styrene foam or the anti-slip rubber sheet and the anti-slip mat is utilized as a constitutional member at the portion contacting the floor, it is possible to decrease the frequency of the problem where the installation position is easily moved due to a decrease in inherent weight caused by the decrease in weight and size of the step platform. As a result, since the step platform may be stably set for use, there is a large effect that the step platform may be used without worrying about the movement of the installation position. Also, the floor of the room provided with the step platform for slow step exercises is not damaged. Further, there is no need to add a rug for protection and anti-slip purposes on flooring such as hard wood flooring, tatami mats, linoleum, tile, and the like. Accordingly, there is an effect that there is no limit on the material of the floor where the platform is to be used as long as the floor is flat.

Further, since a step platform for slow step exercises having different heights may be realized by coupling the same height adjusting blocks, having a shape with the same size width and the same depth, in multiple levels, when the basic structural portion and the plurality of height adjusting blocks are coupled to each other, the entire multi-level-coupled portion substantially forms a rectangular parallelepiped portion. Likewise, there is an effect that the step platform may be easily packed and carried in the multi-level-coupled state, which cannot be obtained in other step platforms.

The step platform for slow step exercises having a display function has an effect that a user may easily conduct objective management of health enhancement himself. Also, when a user graphs the number of times of mounting and dismounting the step platform for slow step exercises every time and every day for self-management (for example, calculation of consumed calories and the like), there is an additional effect that the so-called incentive for exercising by the user increases.

BEST MODES FOR CARRYING OUT THE INVENTION DETAILED DESCRIPTION OF THE PREFERRED EMBODIMENTS

Hereinafter, an embodiment of the invention will be described based on FIGS. 1(*a*), 1(*b*), and 1(*c*). Furthermore, since the respective drawings illustrate that the same structure is provided in each of a left surface portion, a center portion, and a right surface portion so as to be symmetric to each other, only the right surface portion will be described unless there is a particular remark, and the other descriptions will not be illustrated. Hereinafter, the same applies to FIGS. 2, 5, and 6.

Figure 1:
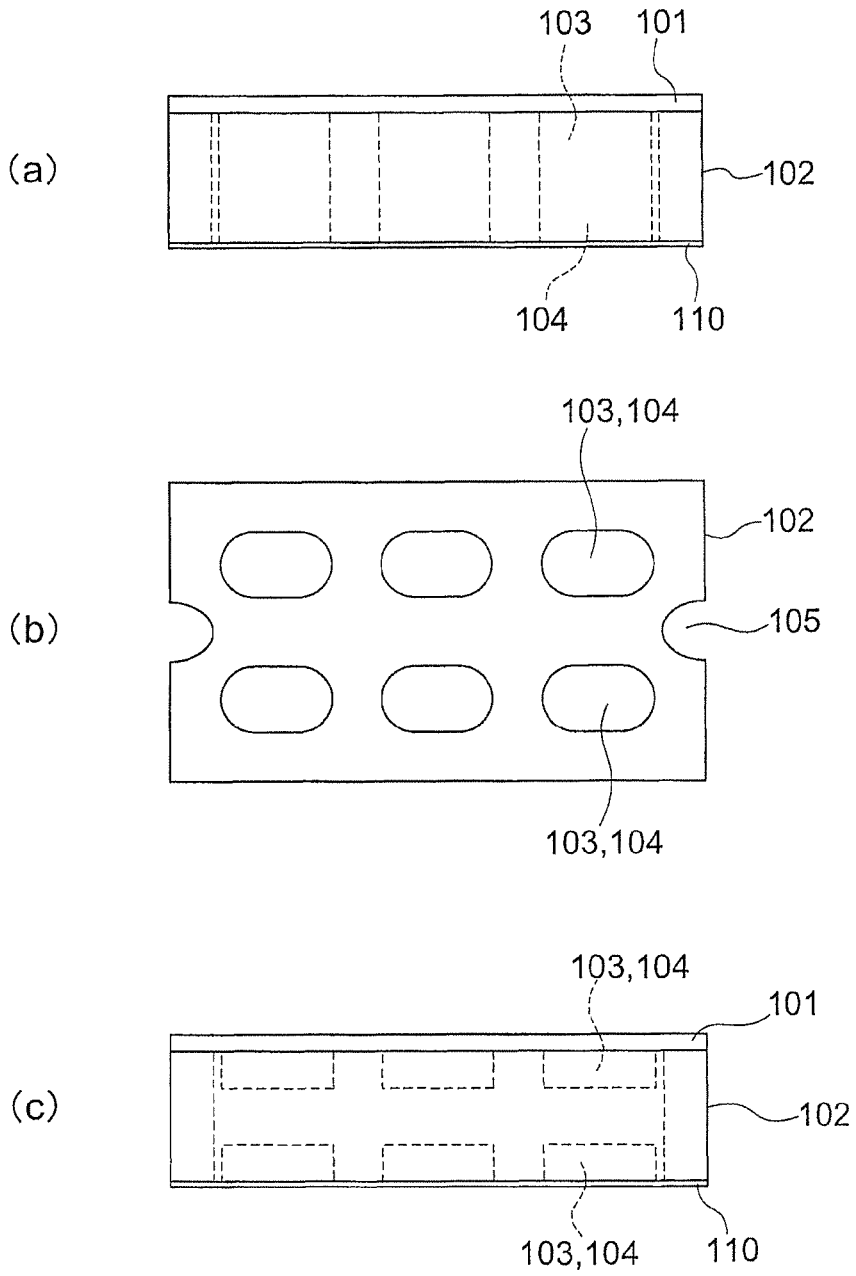
FIG. 1(*a*) is a front view of a basic structural portion of a step platform for slow step exercises of the invention, FIG. 1(*b*) is a plan view of a basic structural block of the step platform, and FIG. 1(*c*) is a front view of a modified example of the basic structural portion of the step platform.

In FIG. 1(*a*), a step platform 101 is provided, and sharp edged portions of a rectangular parallelepiped portion are machined by being smoothly shaved so as to conform when contacting a human body. A basic structural block 102 is provided, and a first hollow hole 103 and a first concave portion 104 are provided. An anti-slip mat 110 is provided. Here, a case will be exemplified in which the first hollow hole is formed as a penetrating hole.

FIG. 1(*b*) illustrates a case in which the basic structural block 102 includes six first hollow holes that are formed in a styrene foam solid block. In the entirety of FIG. 1, a step platform for slow step exercises, that is, a basic structural portion which is lowest in height is formed. Here, the respective positions, the sizes, and the hole shapes of the plural first hollow holes 103 and the plural first concave portions 104 are illustrated, and a portion 105 is formed on the right side surface so that the step platform may be easily carried, the portion being formed by removing the styrene foam in a substantially semi-circular columnar shape. The left side surface is also formed in the same way. Further, as an example, the cross-sectional shape of the hollow hole is formed in a shape in which the straight portions of both left and right surfaces of a rectangular shape are changed to a curved portion of a substantially semi-circular shape. As a modified application example of the step platform, a display device having a function of counting and displaying the number of times of stepping in slow step exercises of the invention may be additionally provided in the step platform, which may be easily realized in the current technique. However, since the mounting and dismounting step sequence of the exercise is unique, there is a need to consider a way of accurately displaying the count value. An example may be supposed in which the stepping load is detected and counted, which will be separately described later with reference to FIGS. 5 and 6.

In FIG. 1(*c*), the basic structural block 102, the first hollow holes 103, and the first concave portions 104 are provided. Here, a case is exemplified in which the first hollow hole includes a non-penetrating portion that is formed inside the penetrating hole, as a modified example of FIG. 1(*a*). Further, 110 is the anti-slip mat.

Figure 2:
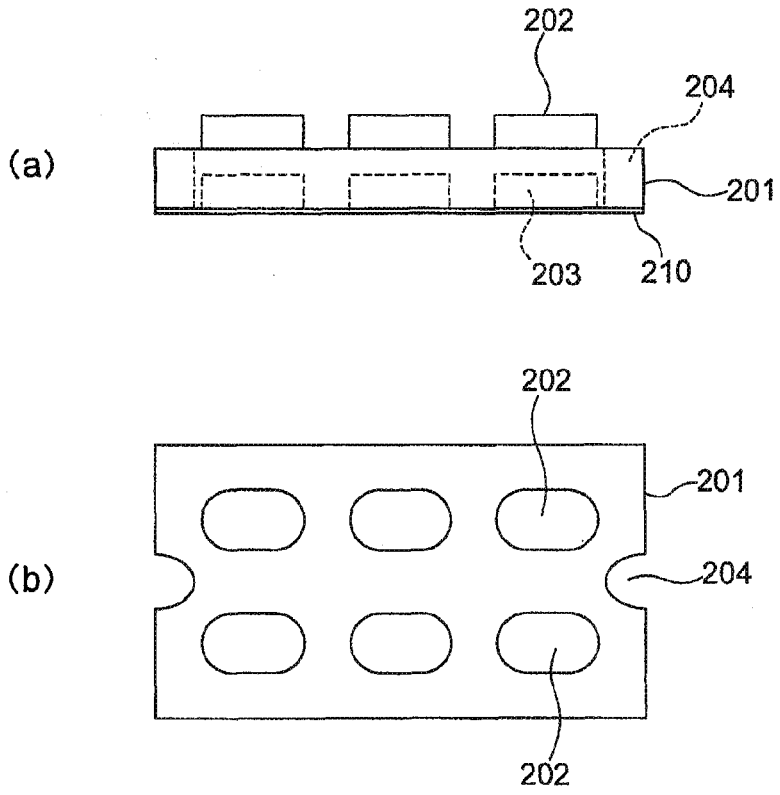
FIG. 2(*a*) is a front view of a height adjusting block of the step platform for slow step exercises of the invention, and FIG. 2(*b*) is a plan view of the height adjusting block.

In FIG. 2(*a*), a height adjusting block 201 is provided, respective convex portions 202 of plural convex portions are provided in the height adjusting block so as to be inserted and coupled to the first concave portions or the second concave portions, and respective concave portions 203 of plural concave portions are provided in the second height adjusting block so as to correspond to the convex portions. In order to perform an easy inserting operation, the front edge portions of the convex portion of the height adjusting block are smoothly shaved, and an urethane treatment is performed on the surface so as to prevent damage to the surface. A predetermined portion 204 is formed so as to correspond to the portion 105 of FIG. 1 by removing the styrene foam in a substantially semi-circular columnar shape, and the entirety of FIG. 2 illustrates an example of the height adjusting block which realizes a multi-level coupling operation. Here, the height adjusting block of the step platform for slow step exercises of the invention need not be necessarily formed of the same material as that of the basic structural portion. For example, compared to the case of forming the basic structural portion, the expansion ratio of the styrene foam may be small (for example, an expansion ratio of 50 times). In this case, the cushioning performance which is the benefit obtained when the material is styrene foam does not decrease, and is sufficiently exhibited in the coupled basic structural portion. The portion 204 is not necessarily needed to attain the formation purpose of the portion 105, but is formed at the position corresponding to that of the portion 105 so as to obtain a united appearance of the entire step platform when the height adjusting block is coupled. Further, 210 is an anti-slip mat.

FIG. 2(*b*) is a plan view of the height adjusting block 201 illustrated in FIG. 2(*a*), and corresponds to the drawing of the hollow holes of the basic structural block of FIG. 1(*b*).

Figure 3:
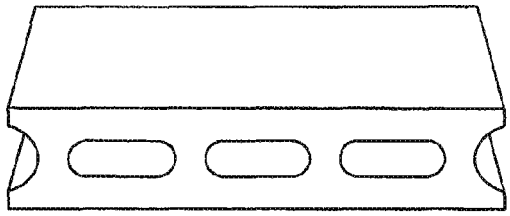
FIG. 3 PRIOR ART
FIG. 3 is a perspective view of a commercially available styrene foam block.

FIG. 3 is a perspective view of a commercially available styrene foam block. In a test model of a block structure in which two blocks are vertically stacked and are stuck to each other by double-sided tape, local cracks were generated in the shortest portion (of which the width of the cross section is about 15 millimeters) of a portion forming a wall between a hollow hole and a peripheral hollow hole at the time point at which a person weighing 70 kg performed slow step exercises about 40,000 times. Therefore, a step platform substantially corresponding to the basic structural portion of FIG. 1 was made as a test model by rotating such a block structure by 90°, and a load bearing performance test was performed thereon. As a result of the test, sufficient load bearing performance and durability were verified. Based on this result, a step platform was designed using styrene foam, and in consideration of safety, the width of the minimum cross section receiving a load was set to 40 millimeters or more at the center portion and also set to 25 millimeters or more in the peripheral portion so as to ensure sufficient margins. FIGS. 1(*b*) and 2(*b*) illustrate the example.

Figure 4:
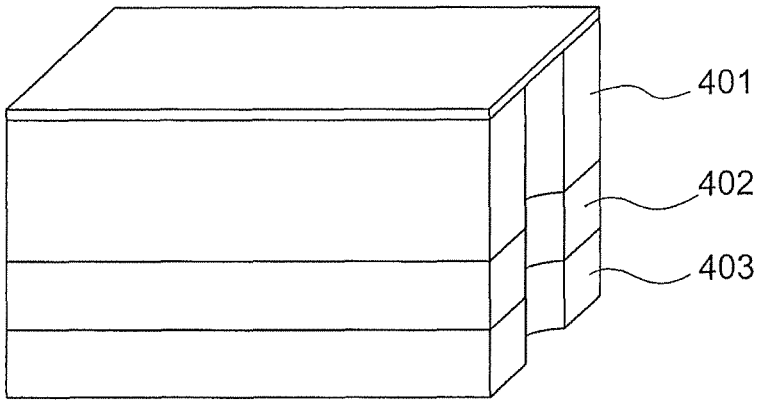
FIG. 4 is a perspective view when the step platform for slow step exercises of the invention is formed in three levels.

FIG. 4 is a perspective view illustrating a case where the step platform for slow step exercises of the invention is formed in three levels. Here, a basic structural portion 401 is provided as in the case of the step platform for slow step exercises of the invention described in FIG. 1(*a*), and a height adjusting block 402 is provided as in the case of the description of FIGS. 2(*a*) and 2(*b*). Another height adjusting block 403 is provided which is completely the same as that of the portion 402. With such a configuration, in the entirety of FIG. 4, a step platform for slow step exercises which is highest in height is formed.

Figure 5:
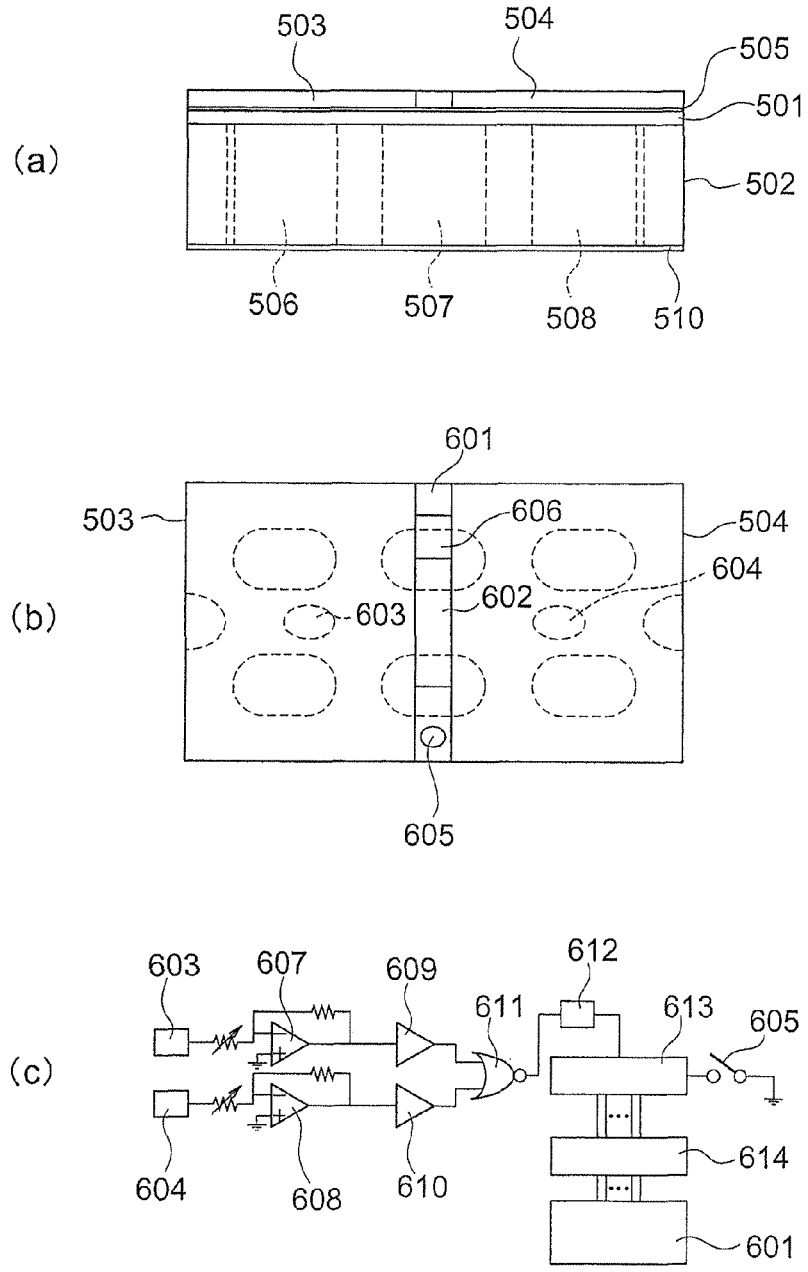
FIG. 5(*a*) is a front view of a basic structural portion of a step platform for slow step exercises equipped with a display function, FIG. 5(*b*) is a plan view of the basic structural portion of the step platform, and FIG. 5(*c*) is a circuit configuration diagram of a display device of the step platform.

FIG. 5 is a diagram illustrating an example of an embodiment when the step platform for slow step exercises of the invention is equipped with a display device having a function of displaying the count of the slow step exercise, that is, a series of mounting and dismounting step operations.

In FIG. 5(*a*), 501 is a first step plate, 502 is a basic structural block, 503 is a second step plate, and 504 is a third step plate. Here, 505 is a spacer which allows a film-like pressure sensor to be conformable between the respective step plates if necessary. 506, 507, and 508 are first hollow holes at three predetermined places among the plural first hollow holes. Further, 510 is an anti-slip mat.

FIG. 5(*b*) is a plan view of the basic structural portion of the step platform for slow step exercises equipped with a display device having a function of displaying the above count. Here, 503 and 504 are the second and third step plates respectively, and a display unit 601 of the display device is provided, which is similar to the display unit of a calculator or a pedometer. The display columns of the count may be, for example, 3 columns from 0 to 999. A power supply unit 602 includes a battery or the like. Left-foot and right-foot load sensors 603 and 604 are provided as film-like pressure sensors which are respectively assembled in the spacers. A push button switch 605 is used to reset the display value to be zero. A display device circuit board 606 of the display device is provided, and constitutes the display device together with the display unit 601. Here, when the gap between the second step plate and the third step plate can not be widened, portions other than the display unit of the display device may be mounted in an empty space of the first hollow hole which is directly below the first step plate.

FIG. 5(*c*) is a circuit configuration diagram of the display device which has a function of generating a pulse signal for tallying the count by detecting the loads being applied by the left and right legs using the respective sensors and stably displaying the count value. Here, the pressure sensors 603 and 604 detect the loads respectively being applied by the left and right legs. Similarly, first and second waveform level adjusting operation amplifiers 607 and 608 are provided, and first and second comparator ICs 609 and 610 are provided, which are set to react only to a signal of a predetermined magnitude or more so that an erroneous operation caused by noise or the like is prevented. 611 is a NOR circuit, and 612 is a retriggerable monostable multivibrator IC, which is triggered at an edge of a signal in which the output of the NOR circuit is reversed at a time point where there absolutely no load being applied by the left and right legs, and generates an electric pulse signal having a predetermined set time interval (for example, several tens of milliseconds to several hundreds of milliseconds), whereby no erroneous operation is caused even when a non-load state occurs for a time shorter than at least the set time interval. Further, a counter IC 613 is provided which counts the last edge of the electric pulse signal. 614 is a seven-segment decoder IC, and the output signal of the counter IC is converted into a seven-segment driving signal in order to display the signal. 601 is the display unit, and uses for example, a liquid-crystal display or the like similar to the display unit of a pedometer. The push button switch 605 is provided which resets the count value. Furthermore, a component formed as a so-called single chip IC that further integrates the respective ICs may also be used. Further, when the display device circuit board is mounted in a space which is interposed between the first step plate and the second and third step plates, there is a need that the display device circuit board be equal in thickness to the second and third step plates for the purpose of protecting against loads. Here, it is obvious that plural load detecting pressure sensors may be integrated as a single sensor and the second and third step plates can be formed as a single integrated step plate in view of load detecting purposes. Further, when the output signal of the retriggerable monostable multivibrator IC 612 is input as a count pulse signal to the display unit of a commercially available pedometer, a compact display device may be provided at low cost.

Figure 6:
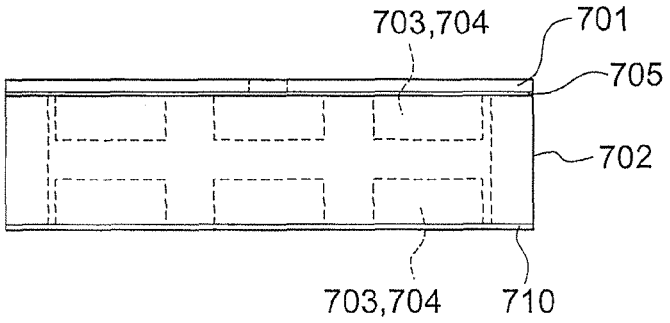
FIG. 6(*a*) is a front view of a modified example of the basic structural portion of the step platform for slow step exercises equipped with the display function, FIG. 6(*b*) is a plan view of the modified example of the basic structural portion of the step platform, and FIG. 6(*c*) is a circuit configuration diagram of a display device of the modified example of the step platform.
Figure 6:
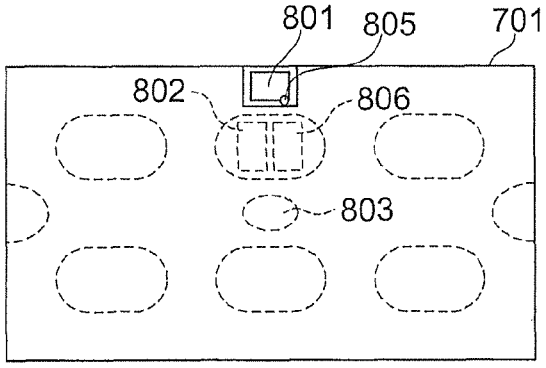
Figure 6:
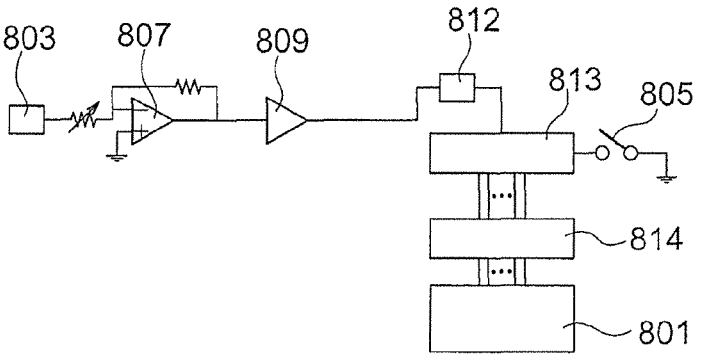

FIG. 6 illustrates a modified example of the basic structural portion of the step platform for slow step exercises equipped with a display function. FIG. 6 is a diagram illustrating another example of the embodiment in which the step platform for slow step exercises of the invention is equipped with a display device having a function of displaying the count of slow step exercises, that is, a series of mounting and dismounting step operations.

In FIG. 6(*a*), a first step plate 701 is provided, and a basic structural block 702 is provided, where a spacer 705 is provided which allows the film-like pressure sensor to be conformable between the respective step plates if necessary. Hollow holes 703 and first concave portions 704 are provided at two predetermined places among the plural first hollow holes and the plural first concave portions. Further, an anti-slip mat 710 is provided.

FIG. 6(*b*) is a plan view of the basic structural portion of the step platform for slow step exercises equipped with the display device having a function of displaying the count. Here, 801 is a display unit 801 of the display device, which is similar to the display unit of a calculator or a pedometer. The display columns of the count may be, for example, 4 columns from 0 to 9999. A power supply unit 802 includes a battery or the like. A load sensor 803 is assembled as a film-like pressure sensor. In this case, there is one load sensor and also one step plate. That is, a case is illustrated in which the load sensor 803 for detecting a load that is applied by the left and right legs during slow step exercise and that is distributed in a single step plate is disposed substantially at the center portion of the upper surface of the basic structural block of the step platform. A push button switch 805 is used so as to reset the display value to zero. A display device circuit board 806 of the display device constitutes the display device together with the display unit 801. Here, when no wide area for mounting the display device can be ensured, the portion other than the display unit of the display device may be mounted in an empty space of the first hollow hole which is directly below the first step plate.

FIG. 6(*c*) is a circuit configuration diagram of the display device which has a function of generating a pulse signal for tallying the count through the detection using the load sensor 803 and stably displaying the count value. Here, as in the case of the description of FIG. 5(*c*), a waveform level adjusting operation amplifier 807 is provided, and a comparator IC 809 is provided, which are set to react only to a signal of a predetermined magnitude or more so that an erroneous operation caused by noise or the like is prevented. Further, a retriggerable monostable multivibrator IC 812 is provided, which is triggered at an edge of an output signal of the comparator IC in which a distributed load is not applied to the step plate, and generates an electric pulse signal having a predetermined set time interval (for example, several tens of milliseconds to several hundreds of milliseconds), whereby no erroneous operation is caused even when a non-load state occurs for a time shorter than at least the set time interval. A counter IC 813 is provided which counts the last edge of the electric pulse signal. A seven-segment decoder IC 814 is provided, and the output signal of the counter IC is converted into a seven-segment driving signal in order to display the signal. 801 is the display unit 801, and uses for example, a liquid-crystal display or the like similar to the display unit of a pedometer. The push button switch 805 is provided which resets the count value. This case is an example in which the installation position is integrated with the display unit 801 as in the case of the commercially available pedometer. Furthermore, compared to FIG. 5, the case of one load sensor is illustrated in FIG. 6, but when plural load sensors are used, it is obvious that a NOR circuit may be used as in the case of FIG. 5. Further, when the output signal of the load sensor 803 is stably obtained, the output of the waveform level adjusting operation amplifier 807 may be directly input to the counter IC 813.

The invention claimed is:

1. A step platform for slow step exercises comprising:

a basic structural block of lightweight styrene foam material having a predetermined generally rectangular outer peripheral configuration and including opposite sides that extend along a length of the basic structural block and opposite ends that extend along a width of the basic structural block, and upper and lower surfaces between which the sides and ends vertically extend;

a plurality of upper openings formed in the upper surface of the basic structural block that are arranged to be aligned in at least one row extending in a lengthwise direction along the upper surface of the basic structural block;

solid portions of the basic structural block disposed between each of the upper openings and the opposite sides of the basic structural block with the openings and solid portions being sized relative to each other so that sufficient surface area is provided along the upper surface of the basic structural block for bearing and distributing the load thereon generated during use thereof; and at least one flat step plate bonded or adhered to the upper surface of the basic structural block to cover the upper openings thereof with the flat step plate lacking projecting portions that are received in the upper openings so that the upper openings remain empty with the flat step plate bonded or adhered to the upper surface to allow for the step plate to flex when impacted during use, wherein the basic structural block includes lower openings formed in the lower surface to be vertically aligned with corresponding ones of the upper openings, and vertically extending portions of the styrene foam material of the basic structural block are disposed in vertical alignment with and between the upper and lower openings, and further comprising:

a height adjusting block with a height adjusting function which is made of a material similar to the styrene foam material of the basic structural block and includes:

a plurality of convex portions formed on the upper surface thereof so as to be respectively inserted and coupled to corresponding ones of the lower openings of the basic structural block; and a plurality of second concave portions formed on the bottom surface thereof by a plurality of second hollow holes formed at a position corresponding to a position directly below the plurality of convex portions so as to have a predetermined depth from the bottom surface.

2. The step platform for slow step exercises according to claim 1, wherein a step platform for slow step exercises having a different height is configured by inserting and coupling the plurality of convex portions, provided in single or plural height adjusting blocks and formed so as to be coupled to corresponding ones of the lower openings of the basic structural block or to the plurality of corresponding second concave portions so that the single or plural height adjusting blocks are coupled to the basic structural block in multiple levels, to the plurality of corresponding lower openings or second concave portions.

3. The step platform for slow step exercises according to claim 2, wherein in a structure in which single or plural load detecting sensors are disposed on a bottom surface of the step plate or a structure in which other single or plural step plates are provided on an upper surface of the step plate and single or plural load detecting sensors are disposed between the step plate and the other single or plural step plates, a display device with a display unit is provided which displays the count of mounting and dismounting of slow step exercises by an electric signal process of the output of the single or plural load detecting sensors.

4. The step platform for slow step exercises according to claim 3, wherein the basic structural block or the height adjusting block has an anti-slip function by bonding or adhering an anti-slip rubber sheet or anti-slip mat to a the lower surface of the basic structural block or a bottom surface of the height adjusting block.

5. The step platform for slow step exercises according to claim 2, wherein the basic structural block or the height adjusting block has an anti-slip function by bonding or adhering an anti-slip rubber sheet or an anti-slip mat to the lower surface of the basic structural block or bottom surface of the height adjusting block.

6. The step platform for slow step exercises according to claim 1, wherein a step platform for slow step exercises having a different height is configured by inserting and coupling the plurality of convex portions, provided in single or plural height adjusting blocks and formed so as to be coupled to the corresponding lower openings or the plurality of second concave portions so that the single or plural height adjusting blocks are coupled to the basic structural block in multiple levels, to the corresponding lower openings or the plurality of corresponding second concave portions.

7. The step platform for slow step exercises according to claim 6, wherein in a structure in which single or plural load detecting sensors are disposed on a bottom surface of the step plate or a structure in which other single or plural step plates are provided on an upper surface of the step plate and single or plural load detecting sensors are disposed between the step plate and the other single or plural step plates, a display device with a display unit is provided which displays the count of mounting and dismounting of slow step exercises by an electric signal process of the output of the single or plural load detecting sensors.

8. The step platform for slow step exercises according to claim 7, wherein the basic structural block or the height adjusting block has an anti-slip function by bonding or adhering an anti-slip rubber sheet or a anti-slip mat to a bottom surface of the basic structural block or a bottom surface of the height adjusting block.

9. The step platform for slow step exercises according to claim 6, wherein the basic structural block or the height adjusting block has an anti-slip function by bonding or adhering an anti-slip rubber sheet or an anti-slip mat to the lower surface of the basic structural block or a bottom surface of the height adjusting block.

10. The step platform for slow step exercises according to claim 1, wherein in a structure in which single or plural load detecting sensors are disposed on a bottom surface of the step plate or a structure in which other single or plural step plates are provided on an upper surface of the step plate and single or plural load detecting sensors are disposed between the step plate and the other single or plural step plates, a display device with a display unit is provided which displays the count of mounting and dismounting of slow step exercises by an electric signal process of the output of the single or plural load detecting sensors.

11. The step platform for slow step exercises according to claim 10, wherein the basic structural block or the height adjusting block has an anti-slip function by bonding or adhering an anti-slip rubber sheet or an anti-slip mat to a bottom surface of the basic structural block or a bottom surface of the height adjusting block.

12. The step platform for slow step exercises according to claim 1, wherein the basic structural block or the height adjusting block has an anti-slip function by bonding or adhering an anti-slip rubber sheet or an anti-slip mat to the lower surface of the basic structural block or a bottom surface of the height adjusting block.

13. A step platform for slow step exercises comprising:

a basic structural block of lightweight styrene foam material having a predetermined generally rectangular outer peripheral configuration and including opposite sides that extend along a length of the basic structural block and opposite ends that extend along a width of the basic structural block, and upper and lower surfaces between which the sides and ends vertically extend;

a plurality of upper openings formed in the upper surface of the basic structural block that are arranged to be aligned in at least one row extending in a lengthwise direction along the upper surface of the basic structural block;

solid portions of the basic structural block disposed between each of the upper openings and the opposite sides of the basic structural block with the openings and solid portions being sized relative to each other so that sufficient surface area is provided along the upper surface of the basic structural block for bearing and distributing the load thereon generated during use thereof; and at least one flat step plate bonded or adhered to the upper surface of the basic structural block to cover the upper openings thereof with the flat step plate lacking projecting portions that are received in the upper openings so that the upper openings remain empty with the flat step plate bonded or adhered to the upper surface to allow for the step plate to flex when impacted during use, wherein the basic structural block includes lower openings formed in the lower surface to be vertically aligned with corresponding ones of the upper openings, and vertically extending portions of the styrene foam material of the basic structural block are disposed in vertical alignment with and between the upper and lower openings.

14. A step platform for slow step exercises comprising:

a basic structural block of lightweight styrene foam material having a predetermined generally rectangular outer peripheral configuration and including opposite sides that extend along a length of the basic structural block and opposite ends that extend along a width of the basic structural block, and upper and lower surfaces between which the sides and ends vertically extend;

a plurality of upper openings formed in the upper surface of the basic structural block that are arranged to be aligned in at least one row extending in a lengthwise direction along the upper surface of the basic structural block;

solid portions of the basic structural block disposed between each of the upper openings and the opposite sides of the basic structural block with the openings and solid portions being sized relative to each other so that sufficient surface area is provided along the upper surface of the basic structural block for bearing and distributing the load thereon generated during use thereof; and at least one flat step plate bonded or adhered to the upper surface of the basic structural block to cover the upper openings thereof with the flat step plate lacking projecting portions that are received in the upper openings so that the upper openings remain empty with the flat step plate bonded or adhered to the upper surface to allow for the step plate to flex when impacted during use, wherein the at least one row of openings comprises a plurality of rows of openings extending in the lengthwise direction along the upper surface so that there are openings in different rows that are adjacent to each other in a widthwise direction across the upper surface, and the solid portions include a first side solid portion between one of the sides and one of the adjacent openings, an intermediate solid portion between the adjacent openings, and a second side solid portion between the other one of the sides and the other one of the adjacent openings.

15. The step platform for slow step exercises according to claim 14, wherein in a structure in which single or plural load detecting sensors are disposed on a bottom surface of the step plate or a structure in which other single or plural step plates are provided on an upper surface of the step plate and single or plural load detecting sensors are disposed between the step plate and the other single or plural step plates, a display device with a display unit is provided which displays the count of mounting and dismounting of slow step exercises by an electric signal process of the output of the single or plural load detecting sensors.

16. The step platform for slow step exercises according to claim 14, wherein the basic structural block has an anti-slip function by bonding or adhering an anti-slip rubber sheet or an anti-slip mat to the lower surface thereof.

17. The step platform of claim 14 wherein the basic structural block includes a plurality of through holes extending between the upper and lower surfaces with each through hole opening at the upper surface to corresponding ones of the upper openings, and each through hole opening at the lower surface to corresponding ones of lower openings formed in the lower surface.

* * * * *

UNITED STATES PATENT AND TRADEMARK OFFICE

CERTIFICATE OF CORRECTION

PATENT NO. : 9,022,912 B2
APPLICATION NO. : 13/581218
DATED : December 2, 2014
INVENTOR(S) : Keishi Matsuno It is certified that error appears in the above-identified patent and that said Letters Patent is hereby corrected as shown below:

On the Title Page:

(73) "Assignee", delete "JunKen Co., Ltd," and insert -- JuKen Co., Ltd. --, therefor.

In the Claims:

Claim 4, Column 14, Line 29, before "the lower" delete "a".

Signed and Sealed this
Twenty-eighth Day of June, 2016

Michelle K. Lee

Michelle K. Lee
*Director of the United States Patent and Trademark Office*